US010947762B2

(12) United States Patent
Summers et al.

(10) Patent No.: US 10,947,762 B2
(45) Date of Patent: Mar. 16, 2021

(54) ARTICULATING MOUNTING BRACKET FOR HANGING DOORS

(71) Applicant: Monadnock Millwork, LLC, West Swanzey, NH (US)

(72) Inventors: Gregg Vincent Summers, Scottsdale, AZ (US); Alwin Golosinda Guittard, Litchfield Park, AZ (US); Peter C. Delaney, Keene, NH (US); Derek Delaney, Keene, NH (US)

(73) Assignee: Monadnock Millwork, LLC, West Swanzey, NH (US)

( * ) Notice: Subject to any disclaimer, the term of this patent is extended or adjusted under 35 U.S.C. 154(b) by 151 days.

(21) Appl. No.: 15/986,336

(22) Filed: May 22, 2018

(65) Prior Publication Data

US 2019/0360248 A1 Nov. 28, 2019

(51) Int. Cl.

| | |
|---|---|
| ***E05D 15/48*** | (2006.01) |
| ***E05D 15/26*** | (2006.01) |
| ***E06B 3/48*** | (2006.01) |

(52) U.S. Cl.

CPC ..... *E05D 15/48* (2013.01); *E05D 15/264* (2013.01); *E06B 3/481* (2013.01); *E05D 2015/485* (2013.01)

(58) Field of Classification Search

CPC ..... E05D 15/063; E05D 15/264; E05D 15/48; E05D 2015/485; E05Y 2201/684; E05Y 2600/626; E05Y 2900/132; E06B 3/481

See application file for complete search history.

(56) References Cited

U.S. PATENT DOCUMENTS

| | | | | | |
|---|---|---|---|---|---|
| 1,243,499 | A | * | 10/1917 | Ferris | E05D 15/264 160/199 |
| RE14,893 | E | * | 6/1920 | Piper | E05D 15/264 160/199 |
| 1,384,763 | A | * | 7/1921 | Jordan | E05D 15/264 160/199 |
| 1,420,087 | A | * | 6/1922 | Frantz | E05D 15/264 160/199 |
| 1,545,565 | A | * | 7/1925 | Lang | E05D 15/26 160/199 |
| 1,821,697 | A | * | 9/1931 | Ferris | E05D 15/12 16/97 |
| 2,842,795 | A | * | 7/1958 | Majeske | E05D 15/266 16/245 |

(Continued)

*Primary Examiner* — James M Ference

(74) *Attorney, Agent, or Firm* — Dergosits & Noah LLP

(57) ABSTRACT

An articulating bracket for a hanging door. The articulating bracket is a two-part structure having a top piece and a bottom piece rotatably coupled together. The bottom piece attaches to a door, and the top piece extends upward from the bottom piece, with a roller wheel attached to the top piece and adapted to roll along a rail mounted above the door. The articulating bracket is particularly advantageous for a pair of doors that are coupled together at their proximal edges. With a first articulating bracket attached at one extreme top position of the first door and a second articulating bracket at the other extreme top position of the second door, one of the articulating brackets is affixed to a supporting structure and the other is free to move with the roller wheel along the rail. As the roller wheel is moved, both of the brackets rotate to follow the outward rotation of the doors.

10 Claims, 16 Drawing Sheets

(56) References Cited

U.S. PATENT DOCUMENTS 2,959,220 A * 11/1960 Latham ..... E05D 15/063 160/199
3,003,551 A * 10/1961 Ferris ..... E05D 15/12 160/196.1
3,205,935 A * 9/1965 Cayton ..... E06B 3/481 160/183
3,246,684 A * 4/1966 Rudnick ..... E06B 3/481 160/118
3,285,324 A * 11/1966 Stein ..... E05D 7/0027 160/206
3,359,594 A * 12/1967 Pastoor ..... E06B 3/481 16/356
3,583,464 A * 6/1971 Johnson, Jr. ..... E05D 15/264 160/206
3,987,837 A * 10/1976 Hewson ..... E05D 15/264 160/206
4,276,919 A * 7/1981 Walters ..... A47K 3/362 160/199
4,432,406 A * 2/1984 Belanger ..... E05D 15/264 160/118
4,726,637 A * 2/1988 Ishizawa ..... E05D 15/26 160/199
4,729,615 A * 3/1988 Ishizawa ..... E05D 15/264 160/199
4,922,987 A * 5/1990 Marontate ..... E05D 15/26 160/183
4,932,455 A * 6/1990 Yamada ..... E05D 15/26 160/118
4,981,164 A * 1/1991 Reichel ..... A47K 3/362 160/187
5,065,807 A * 11/1991 Maeda ..... E05D 15/26 160/206
5,085,262 A * 2/1992 Tutikawa ..... E05D 15/26 160/199
7,699,089 B2 * 4/2010 Knutson ..... E05F 15/605 160/199
8,474,097 B2 * 7/2013 Andren ..... E05D 15/063 16/98
8,844,604 B2 * 9/2014 Pelekanos ..... E05D 15/0656 160/206
D729,049 S * 5/2015 Andren ..... D8/373
9,322,203 B2 * 4/2016 Kleiman ..... E05D 15/26
9,745,786 B2 * 8/2017 Andren ..... E05D 15/063
2002/0170234 A1 * 11/2002 Salice ..... E05D 15/063 49/453
2005/0241781 A1 * 11/2005 Johnson ..... E05F 15/50 160/199
2014/0150208 A1 * 6/2014 Haab ..... E05D 7/00 16/86.2
2016/0076291 A1 * 3/2016 Kleiman ..... E05D 15/063 160/197
2016/0251885 A1 * 9/2016 Conley ..... E05D 15/58 49/127
2017/0298669 A1 * 10/2017 Boring ..... E05D 15/0626
2017/0298671 A1 * 10/2017 Wright ..... E05D 15/0652
2018/0230728 A1 * 8/2018 Downey ..... E05F 5/003
2019/0323275 A1 * 10/2019 Stell ..... E06B 3/5072
2019/0360248 A1 * 11/2019 Summers ..... E05D 15/48

* cited by examiner

ARTICULATING MOUNTING BRACKET FOR HANGING DOORS

BACKGROUND

This disclosure relates generally to the field of mechanical hardware, and more specifically, to a mounting bracket used for hanging doors.

A "barn door" is a well-known hanging door style wherein two brackets are installed in spaced apart locations near the top of the door, with a roller wheel or other rolling or sliding mechanism extending from the bracket and adapted to travel along a compatible rail or track that has been installed above the door, e.g., on an adjacent wall structure.

The barn door style, in addition to conventional farm usage, has become popular for office and residential use, for example, to hide a television/video monitor or to partition open spaces by moving the doors sideways rather than have it open outwardly toward the user. The typical barn door application thus requires significant lateral space to open one or both doors.

It would be desirable to provide a barn door that articulates when opening. The present disclosure describes an articulating bracket that is useful to accomplish that objective.

DETAILED DESCRIPTION

This disclosure is directed to an articulating bracket for a hanging door, such as a barn door, that allows the door to be rotated in addition to moving sideways. This is particularly useful when two or more such doors are positioned adjacent each other and coupled together at their adjacent edges, for example, by one or more hinges.

In one aspect, the bracket includes a top portion that is coupled for linear movement along a rail mounted above the door, and a bottom portion that is coupled to the door, where the top and bottom portions are coupled together to allow rotation relative to each other. In use, the top portion remains fixed in the vertical plane of the rail while the bottom portion rotates with the rotating vertical plane of the door to which the bracket is affixed.

For example, a hanging door system could include a pair of adjacent hanging doors coupled together with hinges installed on the vertical edges between the two doors. A first articulating bracket is affixed to the top of the left-hand side of the left-hand door, and a second articulating bracket is affixed to the top of the right-hand side of the right-hand door. Each of the articulating brackets has a wheel or equivalent rolling or sliding hardware, constructed to be compatible with the rail (or track) installed above the doors, that is affixed to the top portion of each bracket and coupled to the rail. The bottom portion of each bracket is affixed to respective doors as described above.

In one embodiment, the top portion of the first (left-hand) bracket is affixed to the wall, but the top portion of the second bracket (right-hand) is free to move along the rail. Pushing the right-hand door to the left results in the wheel of the corresponding second bracket to move to the left along the rail as the hinged connection between the doors swings outward toward the user, accordion style. Thus, as the doors open, each of the bottom portions of the brackets articulates to follow the door movement, in opposite directions.

In another embodiment, the second bracket is constructed such that the wheel can be removed from the rail, and the doors fully opened and then folded back onto the left-hand door (in this example).

Although the figures and descriptions herein may provide directional and/or spatial orientation of the various components, such as the left-hand bracket is fixed in position while the right-hand bracket is moveable, or the articulating rotation of the bracket is clockwise (or counter-clockwise), these terms are used merely for clarity of illustration and are not intended to be limiting.

Figure 1:
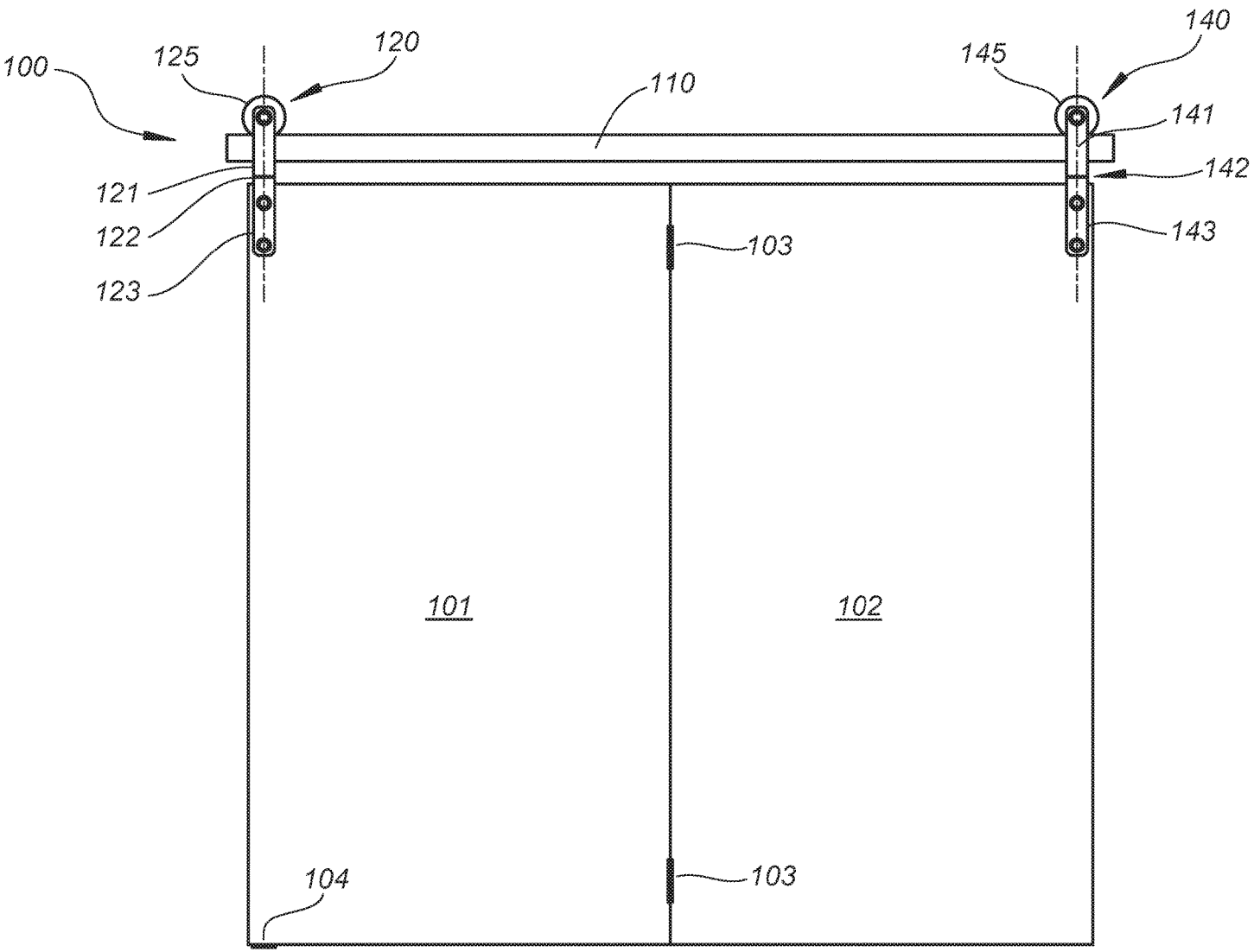
FIG. 1 is a front plan view of a pair of hanging doors having articulating brackets installed on the doors, with the doors in a closed position.
Figure 2:
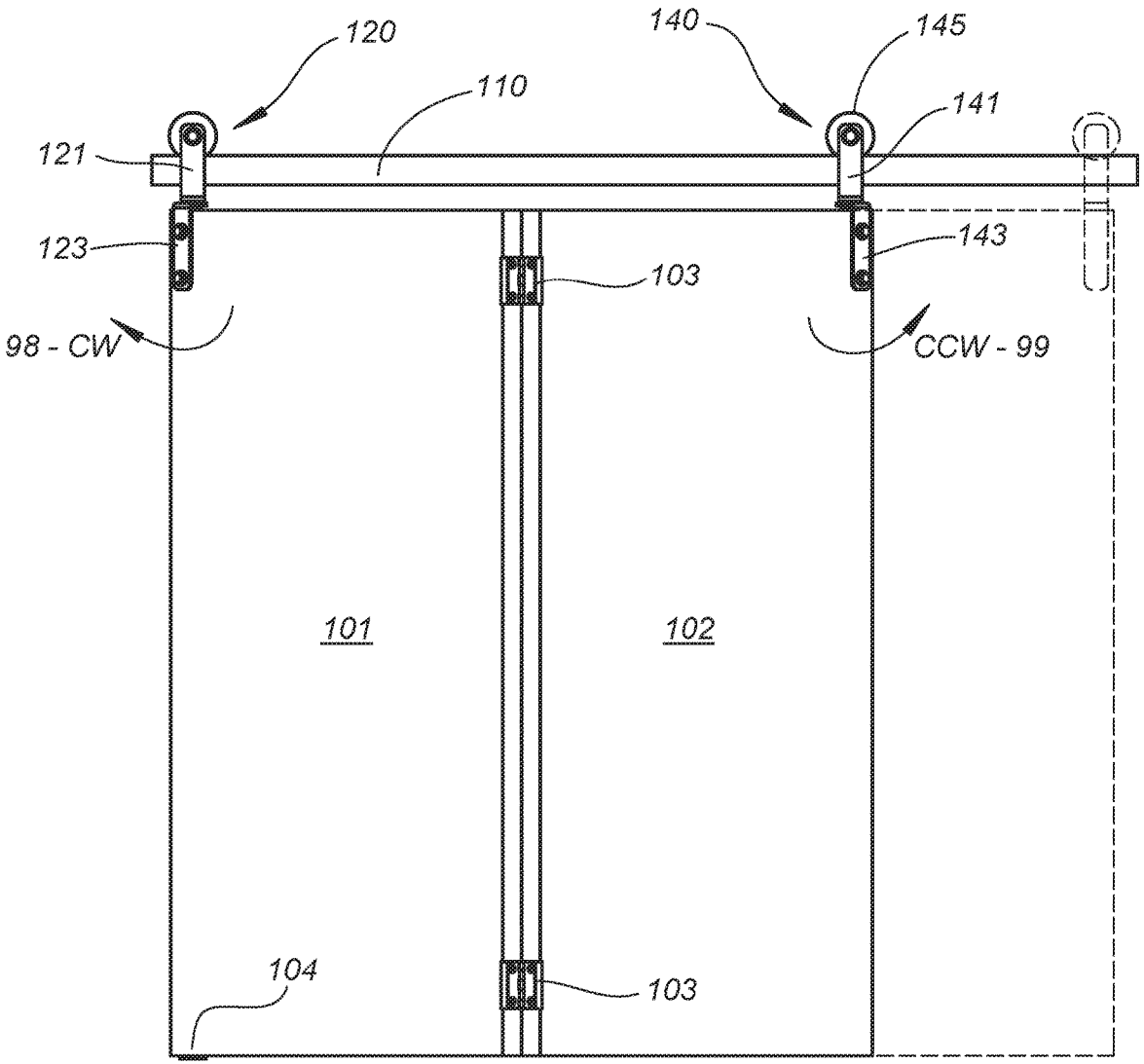
FIG. 2 is a front plan view of the hanging doors of FIG. 1, with the doors in a partially open position.
Figure 3:
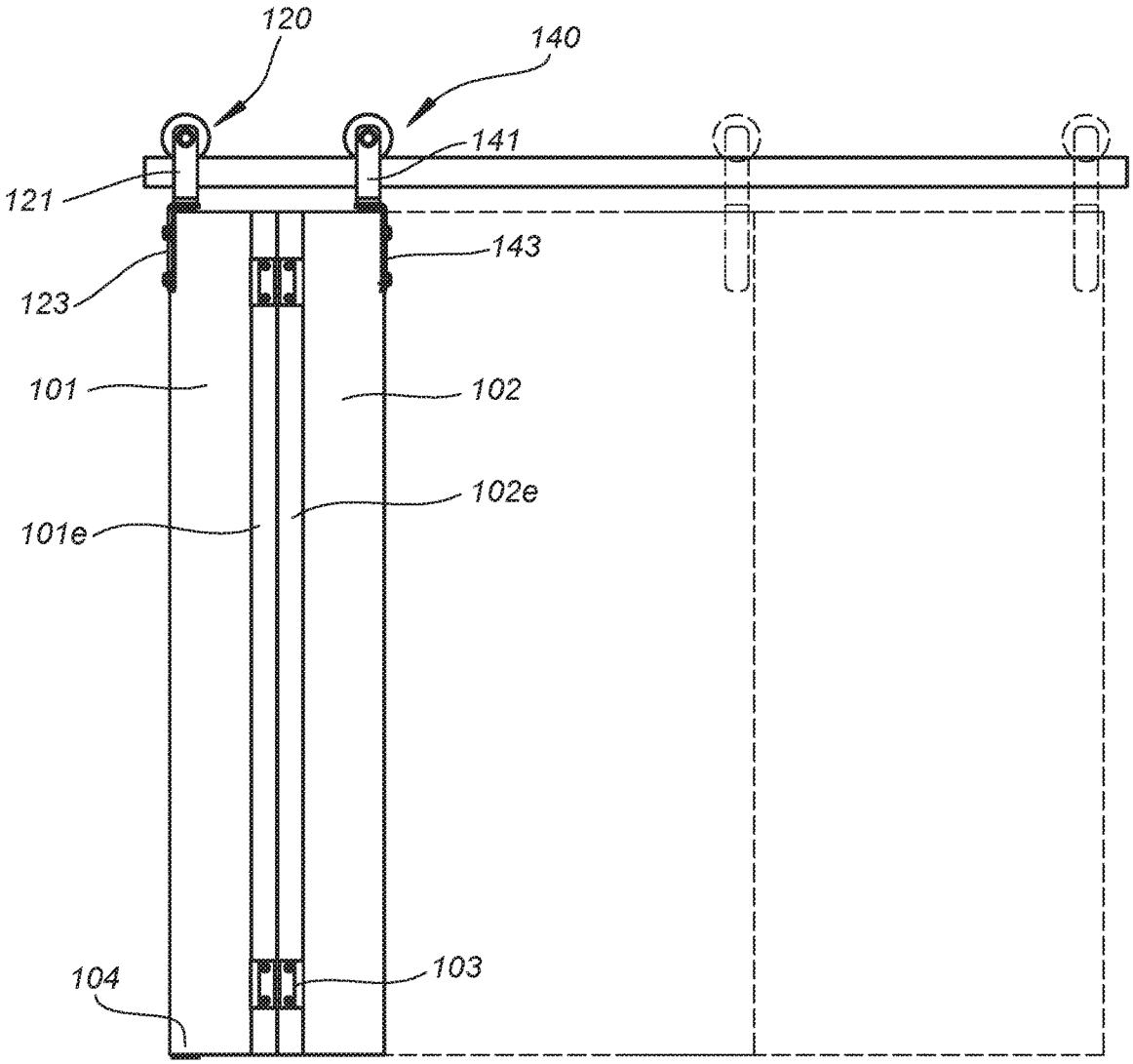
FIG. 3 is a front plan view of the hanging doors of FIG. 1, with the doors in a fully open position.

Referring to FIG. 1, a hanging door system 100 is illustrated that may be referred to as a "barn fold door" style door system. A pair of doors 101, 102 are adapted to hang from a rail 110 via a pair of hanger bracket assemblies 120, 140 installed on the top portion of the doors. In this figure, the doors 101, 102 are shown in the closed position, namely, hiding or blocking some object or space. FIGS. 2-3 show a progression of opening the doors. The rail 110 is typically installed on a wall surface adjacent the object or opening that the doors are intended to cover. The doors 101, 102 are coupled together at their adjacent vertical edges by hinges 103.

The first hanger bracket assembly 120 includes a top bracket portion 121 and bottom bracket portion 123 that articulate in relation to each other at seam 122, and a wheel

125 affixed with the top bracket portion for mating with the rail 110. Similarly, the second hanger bracket assembly 140 includes a top bracket portion 141 and bottom bracket portion 143 that articulate in relation to each other at seam 142, and a wheel 145 affixed with the top bracket portion.

In this embodiment, the top bracket portion 121 of the first bracket assembly 120 is fixed to the wall (see FIG. 9), while the bottom bracket portion 123 is fixed to the top left area of the first or left-hand door 101 and thereby articulates to follow any opening or closing movement of the first door. The second bracket assembly 140, however, is configured such that the top bracket portion 141 is not fixed to the wall but is movable with wheel 145 in a linear direction along the rail 110, while the bottom bracket portion 143 is affixed to the top right area of the second or right-hand door 102 and thereby articulates to follow any opening or closing movement of the second door. A pivot plate 104 is affixed to the bottom portion of the door 101, and a corresponding pivot bracket (not shown) is attached to a cabinet or frame in which the doors are positioned, to allow a fixed point at the bottom left of door 101 for stable rotation of the door. See FIGS. 12-14 and description below.

FIGS. 2-3 show a progression of opening the doors by grasping the right-hand door 102, either by hand or by a handle (not shown) and moving the door to the left (in this example). Since the top portion 121 of the first hanger bracket 120 is affixed to the wall, the left-hand door 101 pivots on bracket 120 and the right-hand door 102 pivots on bracket 140 while the top portion 141 of bracket 140 including wheel 145 moves linearly to the left along rail 110 thereby forcing doors 101, 102 to open outwardly from the middle toward the user, accordion style, via hinges 103, which are now exposed on the inside adjacent edges of the doors. More particularly, the bottom portion 123 of hanger bracket 120 articulates with the door 101 and therefore turns in a clockwise direction with arrow 98 as the door folds opens outwardly, while the bottom portion 143 of hanger bracket 140 articulates with the door 102 and therefore turns in a counter-clockwise direction with arrow 99 as the door folds opens outwardly.

In FIG. 3, the doors 101, 102 have been opened substantially all the way, as the top portion 141 of hanger bracket 140 has moved nearly all the way to the left along rail 110, with the bottom portions 123, 143 of both hanger brackets now turned nearly ninety degrees (in opposite directions) from the top portions 121, 141, which both remain engaged with rail 110. The inside edges 101*e*, 102*e* of doors 101, 102, respectively, are now fully exposed with attached hinges 103. Whether the doors close fully against each other is a design choice based on functionality required, materials, aesthetics, hardware, clearances, etc., and may often be application dependent.

Figure 4:
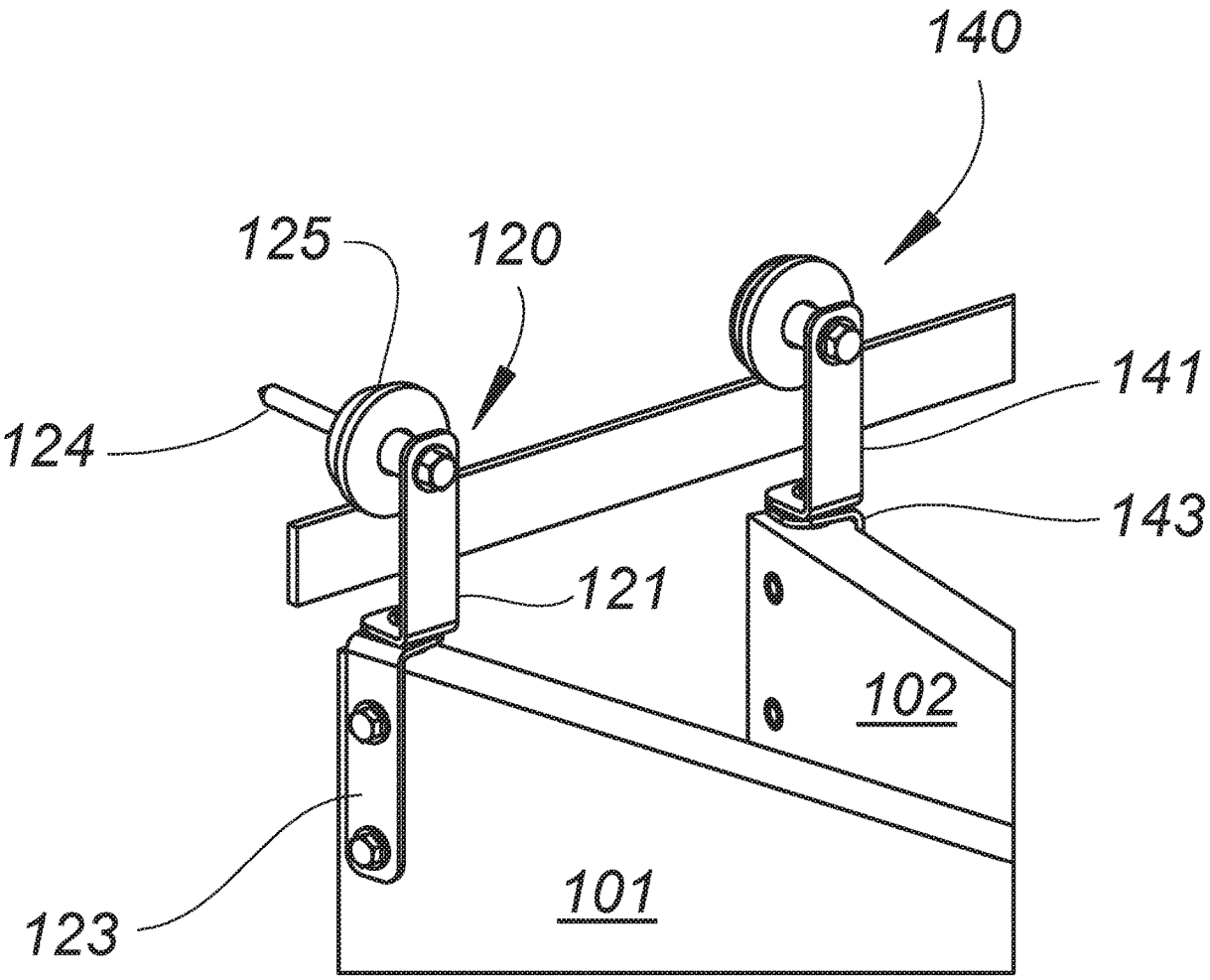
FIG. 4 is a close up perspective view of the articulating brackets of FIG. 1 as the hanging doors approach the fully open position.

FIG. 4 shows a detailed perspective view of hanger brackets 120, 140 as the doors 101, 102 have been moved nearly all the way open, as in FIG. 3. The top portion 121 of hanger bracket 120 includes anchor 124 that is rigidly affixed through wheel 125 into a wall or other structural member (see FIG. 9). In this figure, the bottom portions 123, 143 of the hanger brackets are turned nearly ninety degrees relative to the top portions 121, 141.

Figure 5:
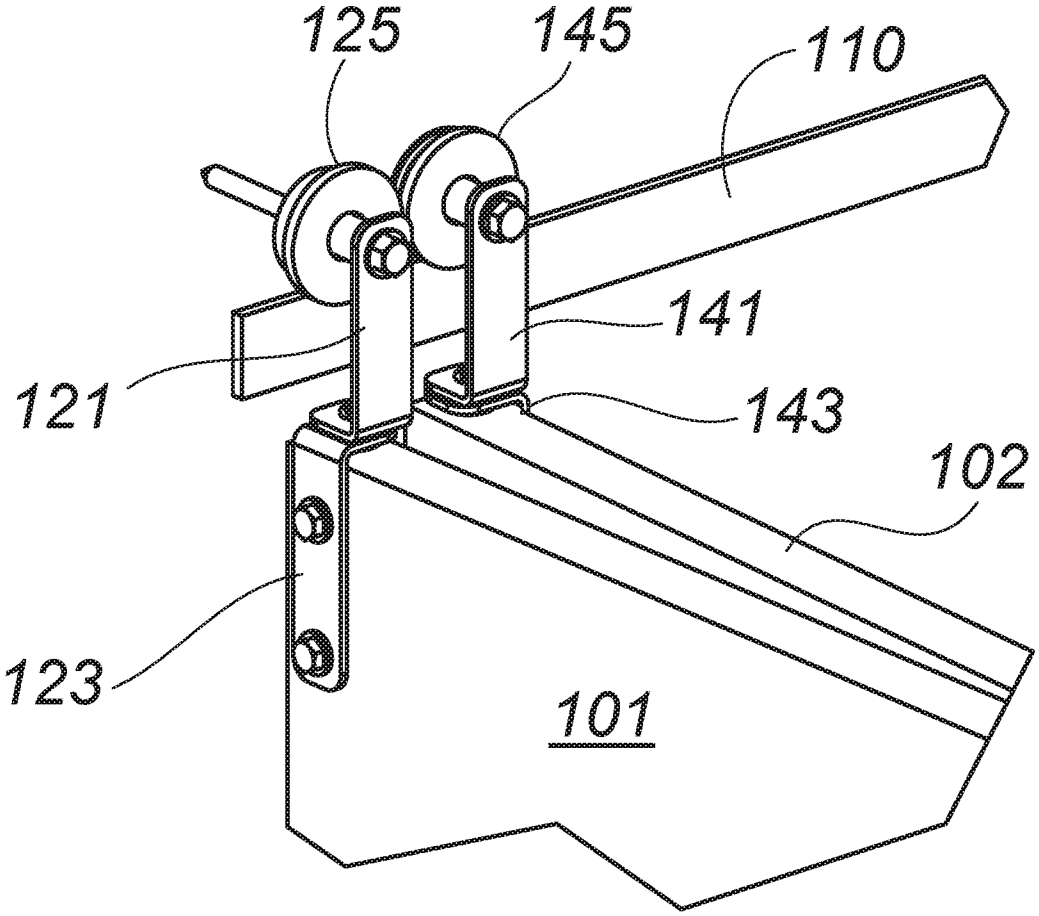
FIG. 5 is a close up perspective view of the articulating brackets of FIG. 1 with the hanging doors in the fully open position.

In FIG. 5, a detailed perspective similar to FIG. 4, the doors 101, 102 have moved as close as they can get with this particular physical embodiment. Bottom portions 123, 143 have articulated to substantially ninety degrees from their original position, and relative to the top portions 121, 141, which both remain engaged in the lateral plane of the rail 110 through wheels 125, 145. However, the moveable wheel 145 is made such that it can be removed from the rail in order to turn the paired doors even further, and because of the articulating hanger brackets 120, 140, the doors may be folded back partway or completely against the wall, as will now be described with reference to FIG. 6.

Figure 6:
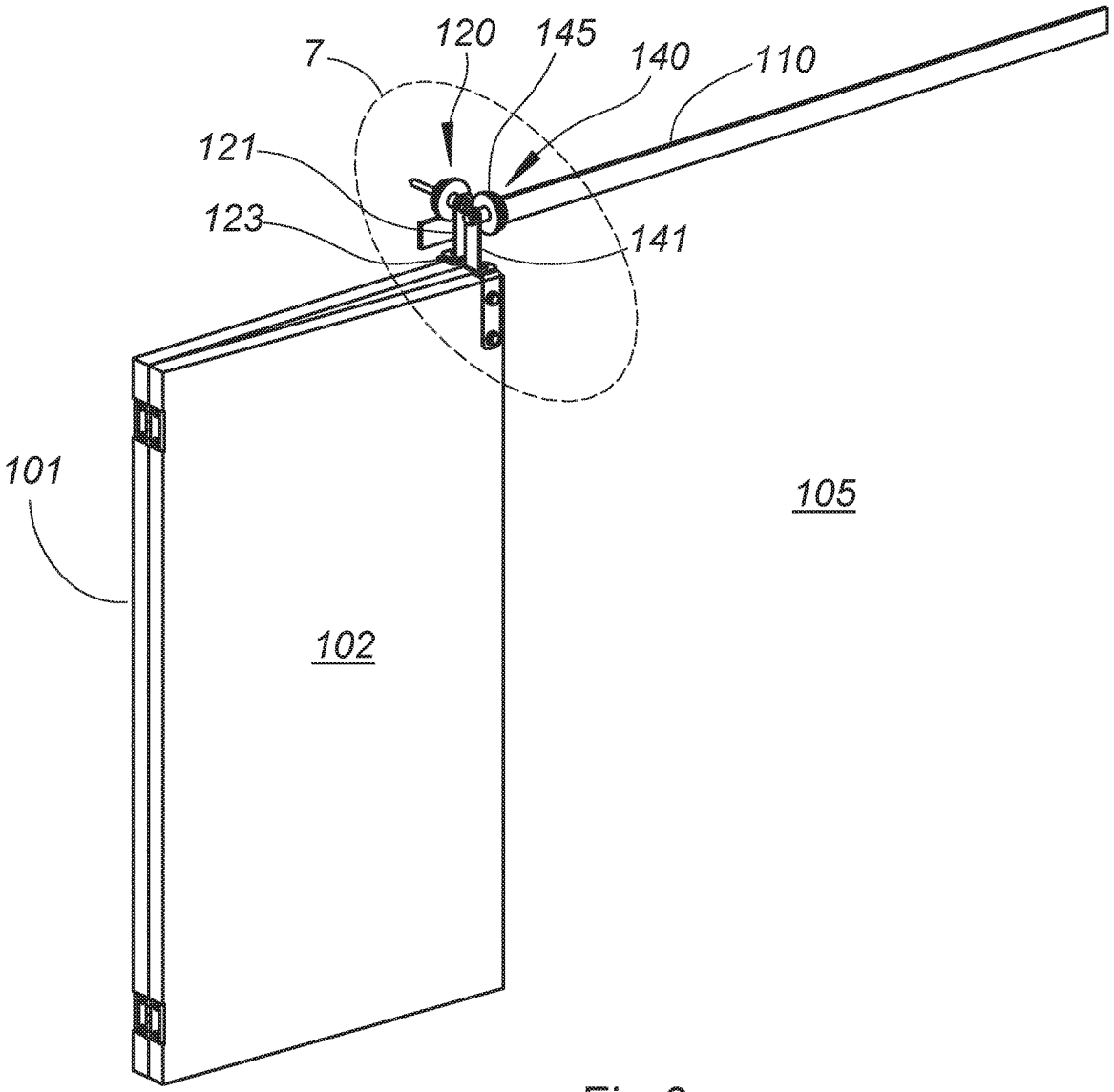
FIG. 6 is a front plan view of the hanging doors of FIG. 1, with the right hand door removed from the rail such that the doors are in an expanded open position.
Figure 7:
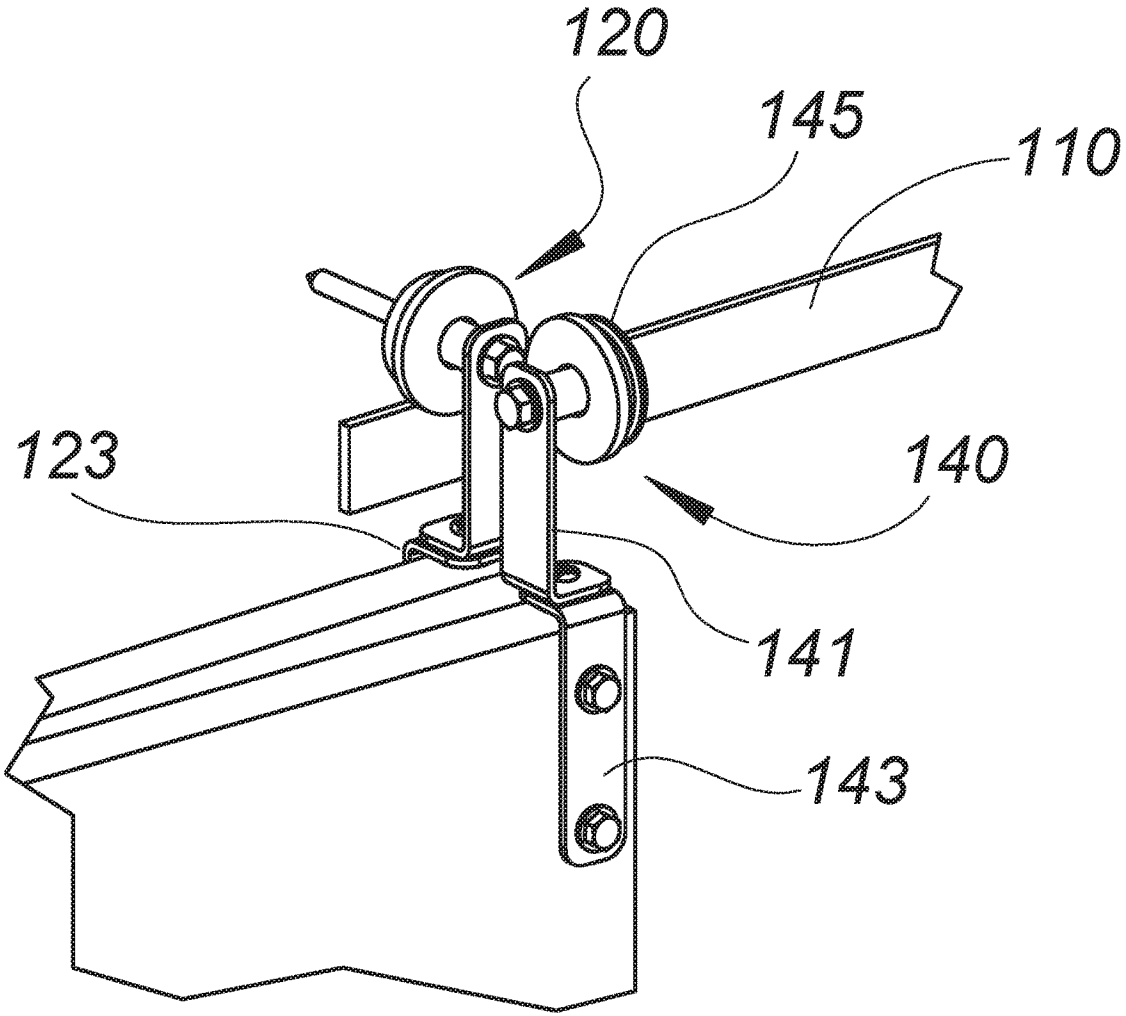
FIG. 7 is a detailed perspective view of the articulating brackets as positioned in FIG. 6.

In FIG. 6, the top portion 141 of hanger bracket 140 on right-hand door 102 has been removed from the rail 110 by pulling the wheel 145 forward and off the rail. As a result, the door 102 can be turned or folded by hand together with door 101, which is still engaged via the top portion 121 of hanger bracket 120 with rail 110 while the bottom portion 123 rotates with door 101 in a further clockwise direction. This folding action can be continued until the doors are resting, or perhaps secured, against the wall to the left of the opening 105, assuming there is adequate lateral room to the left of the doors. This arrangement provides more clearance for viewing the monitor or other object, or using the space, that the doors have been blocking, and also moves the doors further out of the way. In the arrangement of FIG. 6, the top portion 141 of hanger bracket 140 is now turned a full ninety degrees from the rail 110 and from the top portion 121 of hanger bracket 120. The bottom portion 123 of hanger bracket 120 is now turned one hundred eighty degrees from its original position, as more clearly illustrated in FIG. 7. The wheel 145 affixed to top portion 141 of hanger bracket 140 must be configured to be removable from and replaceable to the rail 110, as described below with reference to FIG. 10.

Figure 8:
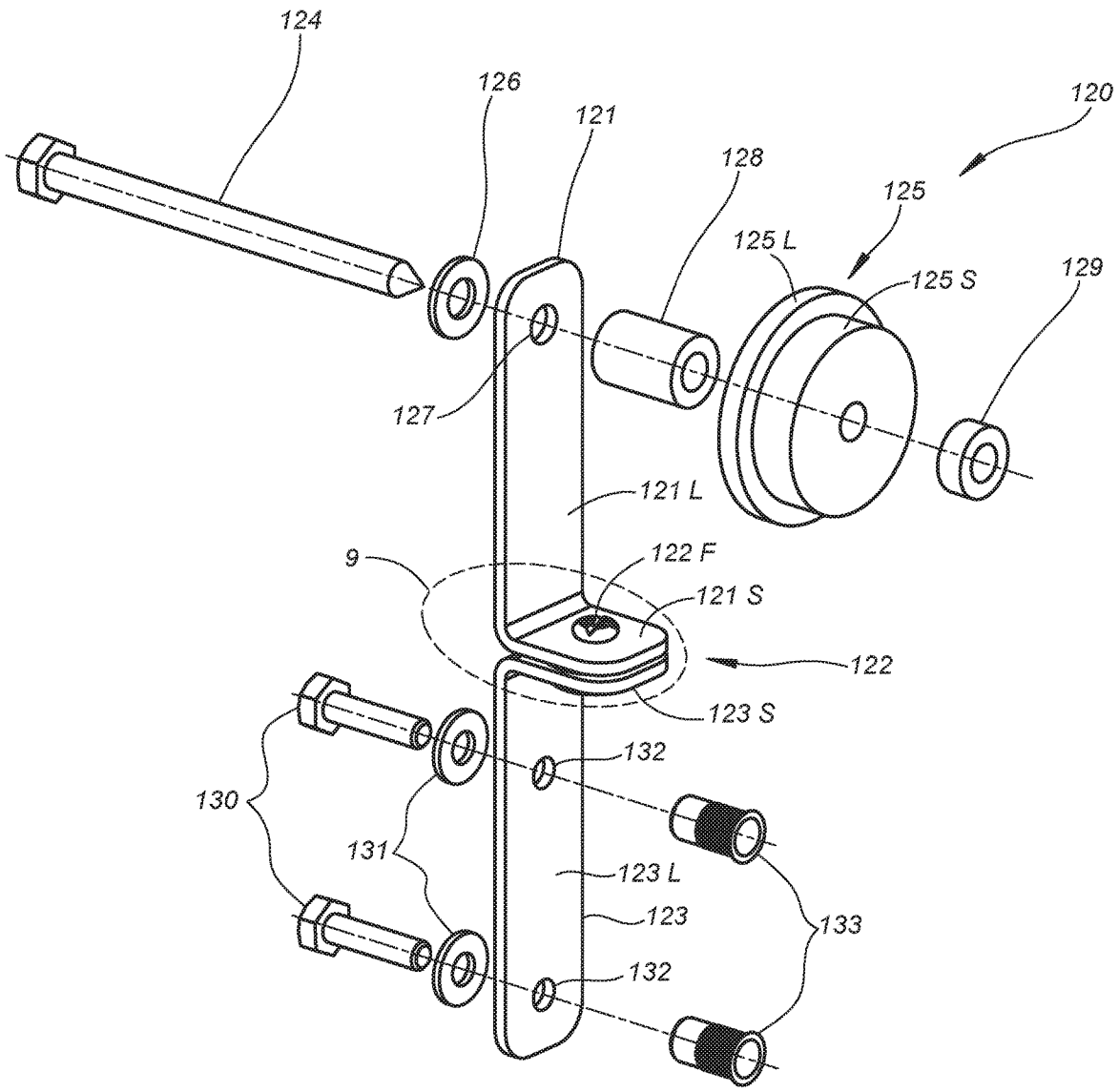
FIG. 8 is a perspective view of the articulating bracket that is fixed in position, with some of the fastener elements shown in exploded view.

An embodiment of articulating hanger bracket 120 is illustrated in FIG. 8 with the fasteners shown in exploded view. The top portion 121 and bottom portion 123 are similar components coupled together for rotation at contact point 122. Each portion 121, 123 is an L-shaped bracket, with long sides 121L, 123L disposed in a vertical orientation and short sides 121S, 123S disposed in a horizontal orientation such that the long and short sides are orthogonal to each other. The short sides 121S, 123S of portions 121, 123 are coupled together with fastener 122F such that the long side 121L of the top portion 121 extends upwardly and the long side 123L of the bottom portion 123 extends downwardly.

Figure 9:
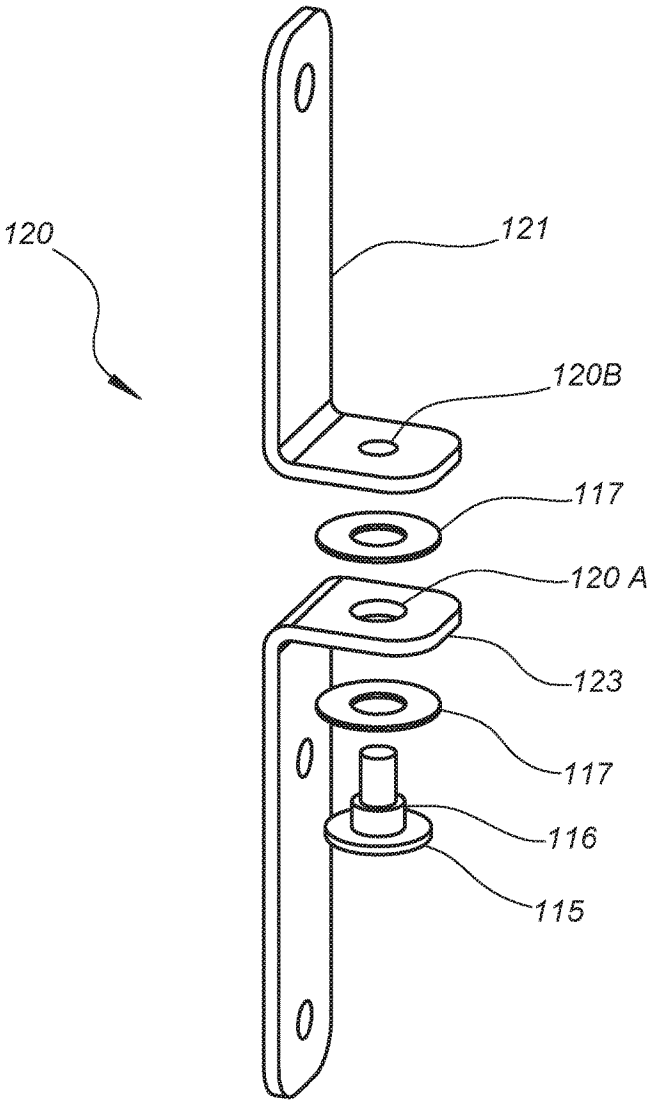
FIG. 9 is a perspective view of the articulating bracket of FIG. 8, with the remainder of the fastener elements shown in exploded view.

FIG. 9 is an exploded view showing one embodiment of fastener 122F coupling the top and bottom portions of hanger bracket 120. A shoulder rivet 115 is inserted in sequence through a plastic washer or shim 117, an opening 120A in the short side 123S of the bottom portion 123, another shim 117, and the opening 120B in the short side 121S of the top portion 121, and then the tail end of the rivet is swaged to deform it and hold the it tightly in place. The shoulder portion 116 of the shoulder bolt is adjacent the head of the rivet and allows the top and bottom portions 121, 123 to rotate relative to each other.

Returning to FIG. 8, the top portion 121 of bracket 120 is affixed to a wall (or other support structure) by an anchor 124 inserted through a washer 126 on one side of the bracket 120, through an opening 127 formed near the top end of the long side 121L of the bracket, then through a wheel spacer 128 on the other side of the bracket, wheel 125, and wall spacer 129, in sequence. The anchor 124 may be any suitable fastener, such as a wood screw for attaching directly to a wood stud in the wall, or a metal screw for attaching to a steel frame structure, or a molly-type expandable fastener for attaching to drywall where there is no stud in the desired location.

The wheel 125 has a lip 125L or flanged portion formed with a larger diameter as the exterior portion of the wheel, and a shoulder 125S formed with a smaller diameter as the interior portion of the wheel. The shoulder 125S is configured to run along the rail 110 and the larger lip 125L maintains contact against the rail. In many conventional configurations, a wheel is formed with symmetrical lips on both sides extending above the shoulder (or groove) formed in the middle such that the wheel is held on the rail. However, in this embodiment, the top portion 121 of bracket 120 is fixed in place, and thus wheel 125 just acts as a spacer and does not travel or rotate.

The bottom portion 123 of hanger bracket 120 is affixed to the door 101 with a pair of fasteners 130 that are appropriate for use with door 101. For example, for many types of door materials, the fastener 130 would insert through a washer 131 then through a pair of openings 132 formed in the long side 123L of bracket 123, to terminate either directly into the door 101, e.g., as a wood screw-type fastener, or preferably, into a threaded insert 133 installed in the door with a threaded bolt-type fastener.

Figure 10:
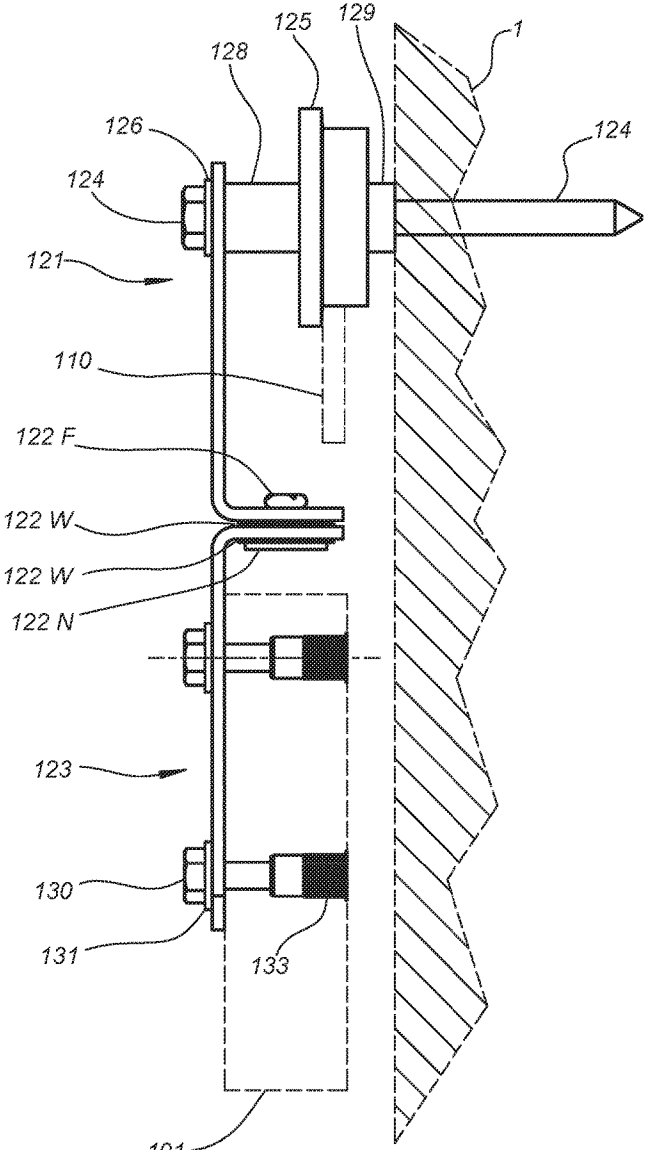
FIG. 10 is a side plan view illustrating the articulating bracket of FIG. 8 as installed in a wall.

FIG. 10 illustrates, with a side view, how the hanger bracket 120 is affixed to door 101 and a wall 1. As already described in relation to FIG. 8 above, the anchor 124 is inserted through a washer 126, the upper portion 121 of hanger bracket 120, wheel spacer 128, wheel 125, and wall spacer 129, before being secured in the wall 1. The spacer 129 provides separation for the top portion 121 of hanger bracket 120 from the wall 1, while the spacer 128 provides separation between the wheel 125 and the front side of top portion 121 in order to match the position of bottom portion 123 as affixed to door 101. Again, it is noted that wheel 125 merely acts as a spacer in this embodiment. The bottom portion 123 of hanger bracket 120 is affixed to door 101 by fasteners 120 into threaded inserts 133.

Adequate spacing is required for all components. For example, rail 110 is typically a flat elongated member having a modest width (or track) that installed to have a modest spacing from the wall, such as 9/16 inch. The door 101 (and door 102) should be hung to have substantially the same spacing from the adjacent wall, or closet, or cabinet. The brackets, fasteners, wheels, washers and spacers are sized appropriately for the materials and application.

Figure 11:
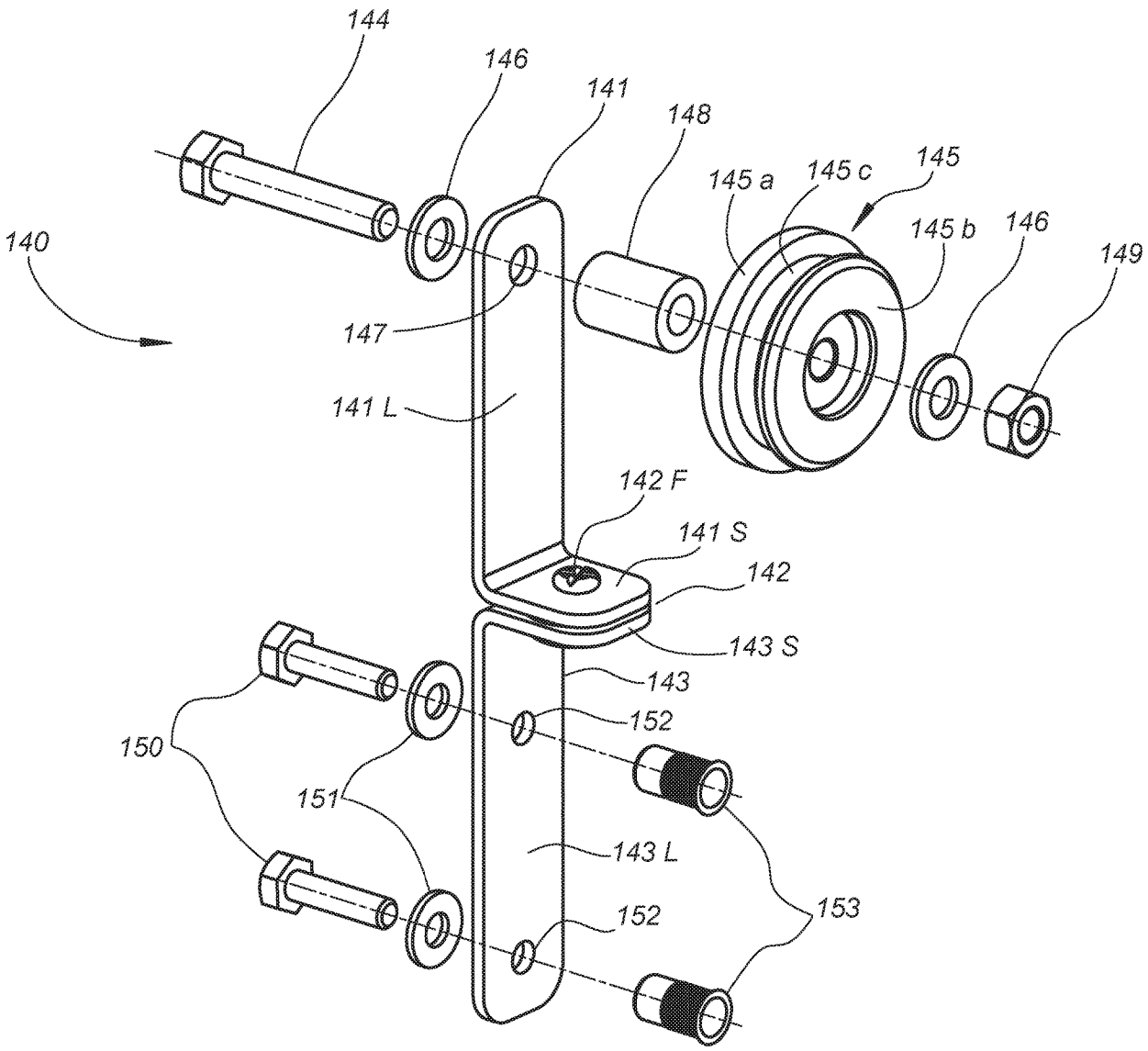
FIG. 11 is a perspective view of the articulating bracket that travels along the rail.

FIG. 11 presents one embodiment of hanger bracket 140, that is, the bracket that is movable to travel in a linear direction along rail 110. As with the fixed hanger bracket 120, the top portion 141 and bottom portion 143 of hanger bracket 140 are similar components coupled together for rotation at contact point 142. Each portion 141, 143 is an L-shaped bracket, with long sides 141L, 143L disposed in a vertical orientation and short sides 141S, 143S disposed in a horizontal orientation such that the long and short sides are orthogonal to each other. The short sides 141S, 143S of portions 141, 143 are coupled together with fastener 142F such that the long side 141L of the top portion 141 extends upwardly and the long side 143L of the bottom portion 143 extends downwardly. The details of fastener 142F are the same as fastener 122F, described above.

The top portion 141 of bracket 140 supports the wheel 145. A fastener 144, e.g., a threaded bolt-type fastener, is inserted through a washer 146 on one side of the hanger bracket 140, through an opening 147 formed near the top end of the long side 141L of the hanger bracket, then through a wheel spacer 148 on the other side of the hanger bracket, wheel 145, another washer 146, and nut 149, in sequence. Thus, the wheel 145 is fastened to the top portion 141 of hanger bracket 140.

Figure 12:
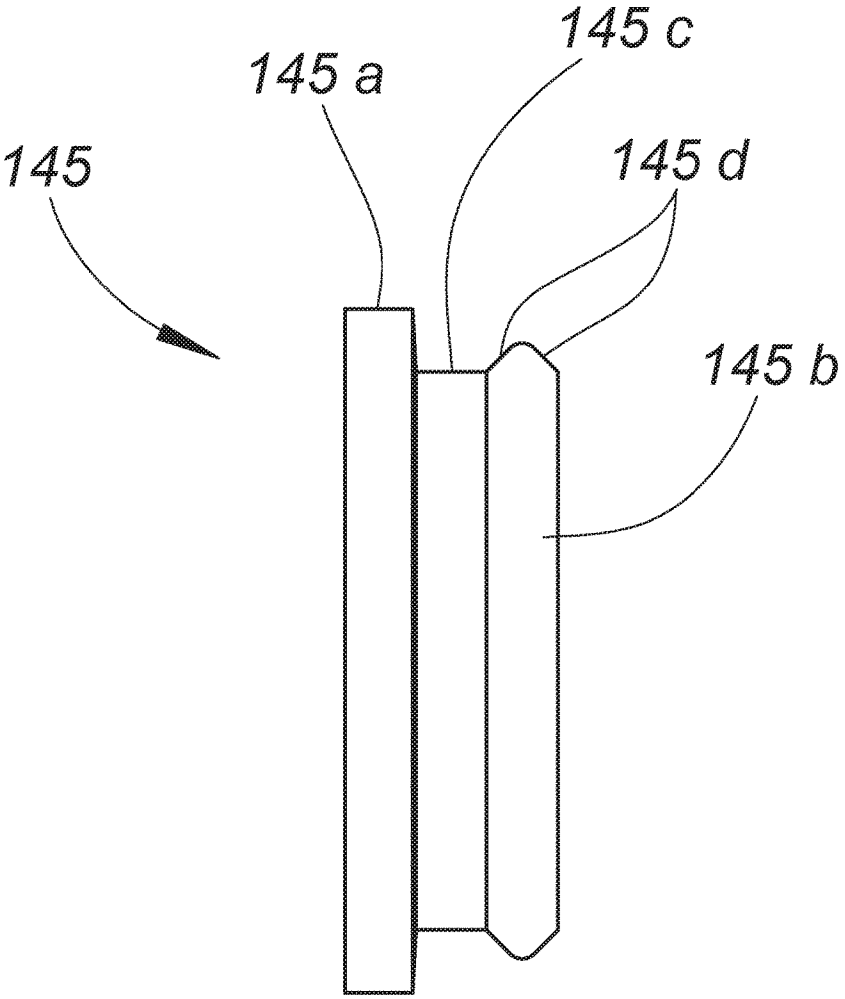
FIG. 12 is a side plan view of the asymmetrical wheel shown in FIG. 11.

It is noted that wheel 145 is asymmetrical, and thus configured differently than wheel 125, as better illustrated in FIG. 12. The wheel 145 has a first lip 145*a* formed as the exterior portion of the wheel and a second lip 145*b* formed as the interior portion of the wheel, with a lower shoulder or groove 145*c* formed between the two lips. The first lip 145*a* is formed such that its edge has a set width for contacting the rail 110. The groove 145*c* is slightly wider than the rail 110. The second lip 145*b*, however, has a slightly smaller diameter that the first lip 145*a*, and also has beveled edges 145*d*, for example, each having a 45 degree beveled face, both features helpful for easy relocating the wheel 145 on and off the rail 110.

Returning to FIG. 11, the bottom portion 143 of bracket 140 is affixed to the door 102 (not shown in this figure) with a pair of fasteners 150 that are appropriate for use with the material of the door. In one embodiment, the fasteners 150 are inserted through washers 151 then through a pair of openings 152 formed in the long side 143L of hanger bracket 143, to terminate either directly into the door 102, e.g., as a wood screw-type fastener, or preferably, into a threaded insert 153 installed in the door with a threaded bolt-type fastener.

Figure 13:
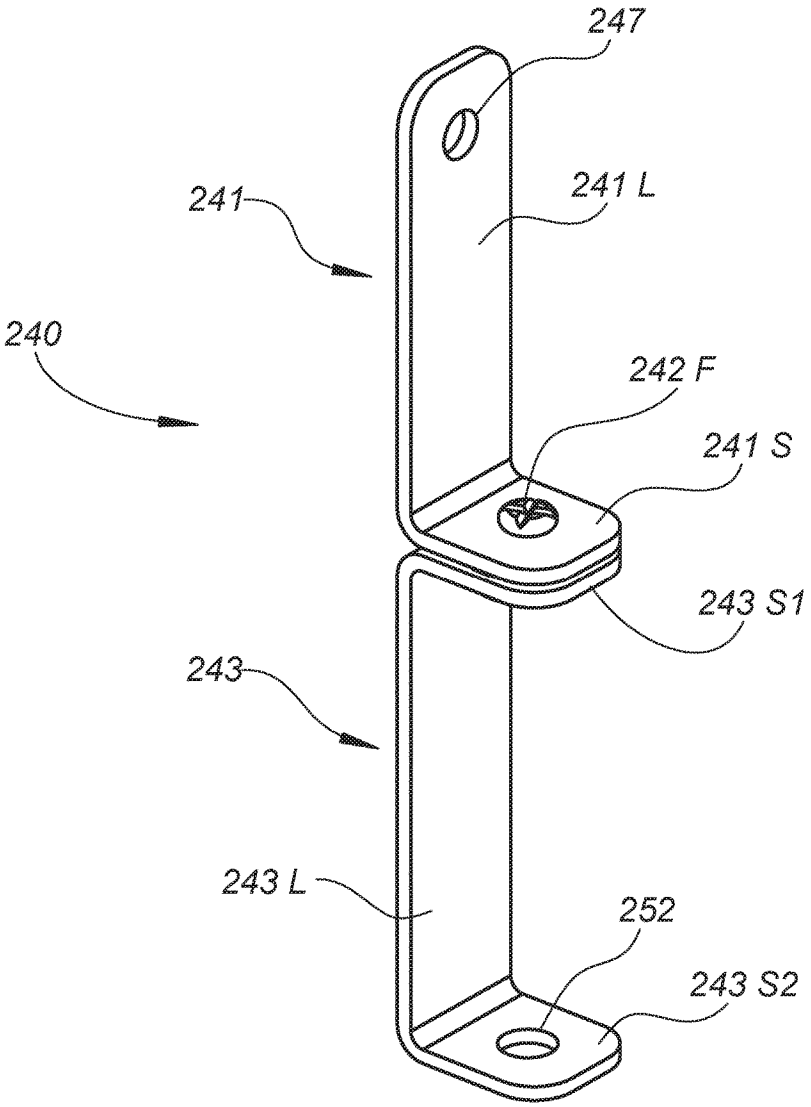
FIG. 13 is a perspective view of an alternative embodiment of the articulating bracket.

An alternative hanger bracket embodiment 240 is illustrated in FIG. 13. In this embodiment, the top portion 241 is the same as in FIG. 10, with a hole 247 formed near the top of long side 241L and a fastener 242F coupling the bottom portion 243 at the short side 241S. The bottom portion 243 still has a long side 243L and a short side 243S1 that is coupled to the top portion 241, but there is also a second short side 243S2 at the bottom of the bottom portion for affixing the bottom portion to the top edge of a door rather than the front face. This hanger 240 may thus be used in the same way as described above, for either the first or second hanger bracket.

Figure 14:
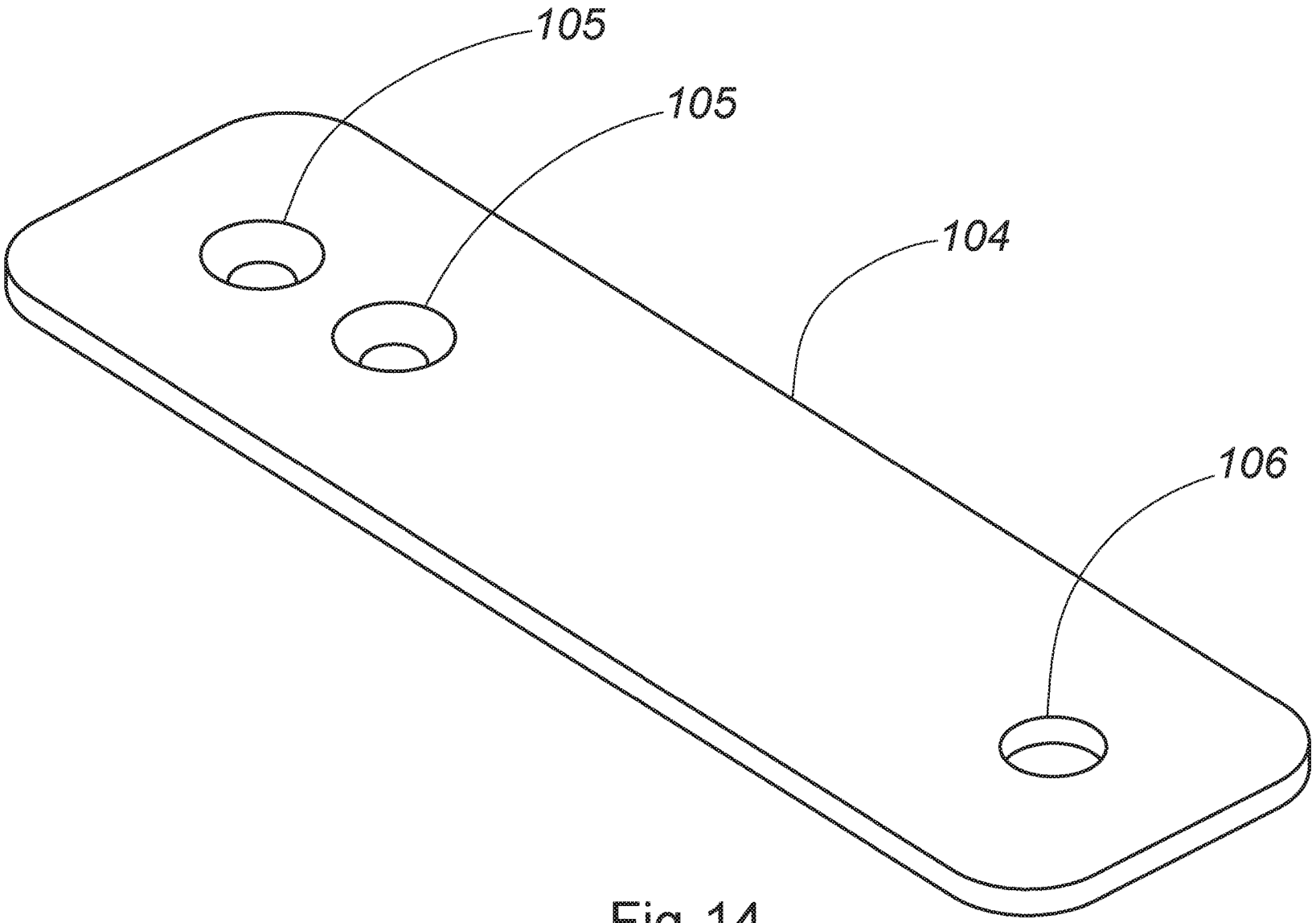
FIG. 14 is a perspective view of a pivot plate.

FIG. 14 illustrates the pivot plate 104 previously shown in FIG. 1. The pivot plate 104 is simply a flat plate that attaches to the bottom edge of a door (as illustrated in FIG. 1). A pair of holes 105 are formed on the plate for affixing the plate to the door. Another hole 106 or pin receptacle is formed at the end of the plate for receiving a pivot pin from corresponding pivot hardware affixed to the structure adjacent the door, as shown on FIGS. 15-16.

Figure 15:
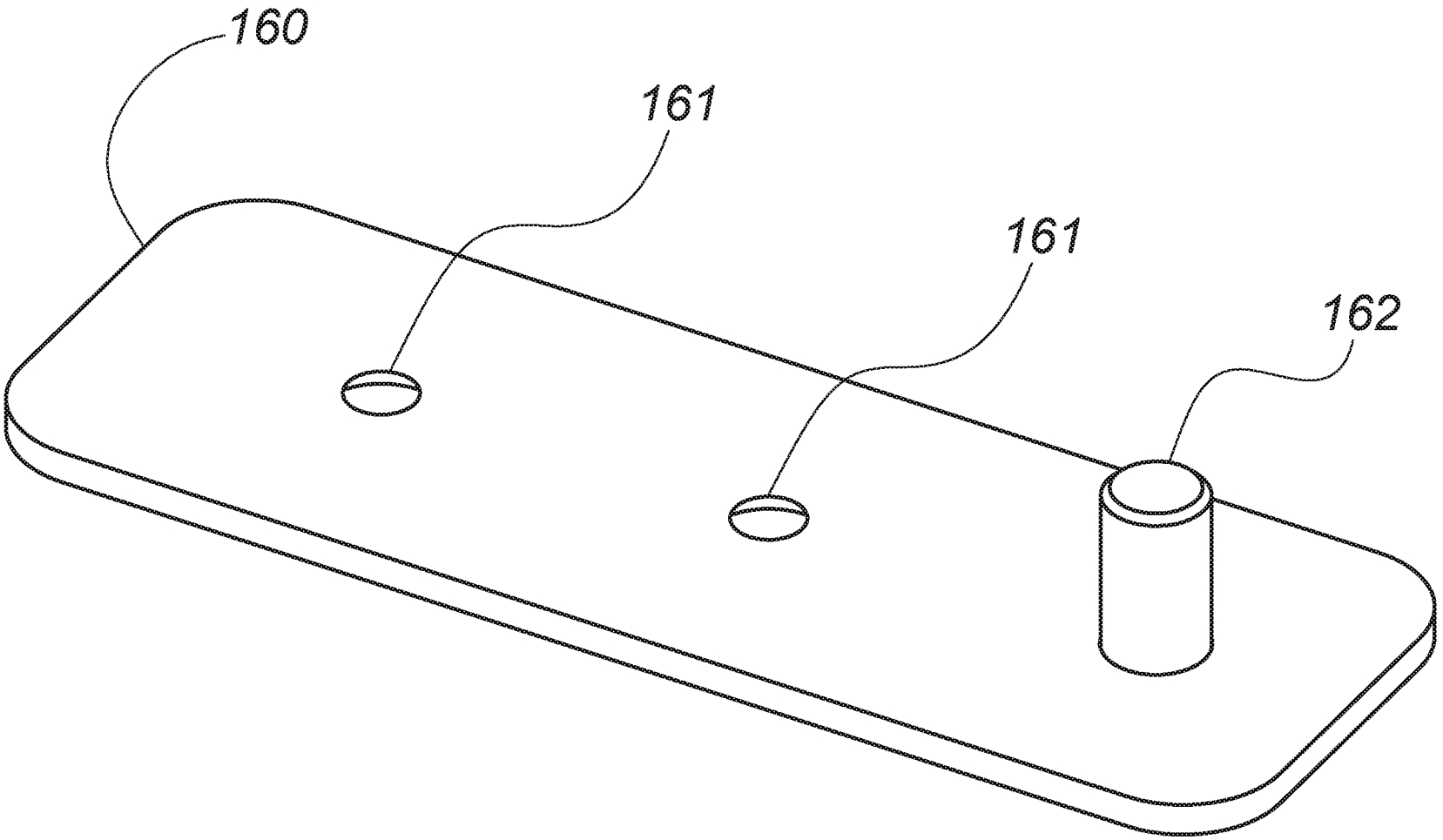
FIG. 15 is a perspective view of one embodiment of a pivot bracket that works with the pivot plate of FIG. 14.

In FIG. 15, a first embodiment of pivot bracket 160 is simply a flat plate that may be installed below the pivot plate 104 adjacent door 101, for example, to a cabinet or similar enclosure. The pivot bracket 160 has two holes 161 for affixing the bracket, and a pin 162 that extends upward to mate with the pin receptacle 106 on pivot plate 104.

Figure 16:
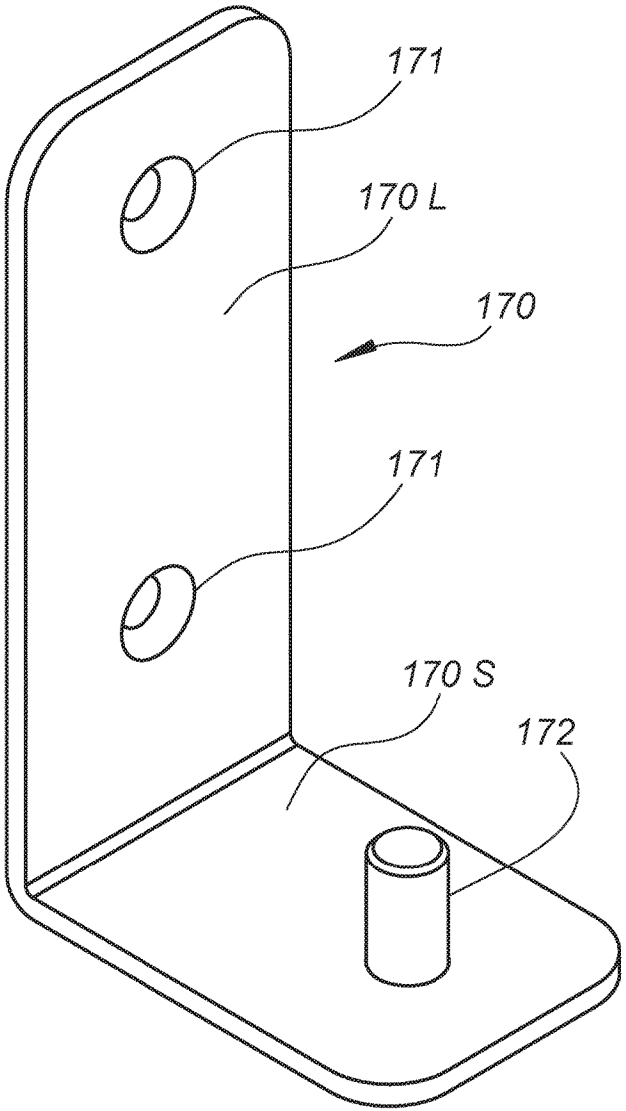
FIG. 16 is a perspective view of another embodiment of a pivot bracket that works with the pivot plate of FIG. 14.

In FIG. 16, a second embodiment of pivot bracket 170 is a L-shaped plate having a long side 170L and a short side 170S orthogonal to the long side. Pivot bracket 170 may be installed with its long side 170L on a side wall or cabinet side wall, with the short side 170S extending under the door 101 at the pivot plate 104. The pivot bracket 170 has two holes 171 on the long side 170L for affixing the bracket, and a pin 172 on the short side 170S that extends upward to mate with the pin receptacle 106 on pivot plate 104.

The embodiments described herein may be constructed from different materials appropriate for the application. For example, the top and bottom portions of the hanger brackets may be made of metal such as 14-gauge carbon steel, with an aesthetically pleasing finish coat. However, it is conceivable that a molded plastic bracket could suffice for smaller, lightweight applications, but likely not for large steel or wood doors. The mechanical hardware, such as fasteners, washers and spacers described herein, are conventional and may be available in stainless or galvanized steel or other common metal alloys. The roller wheel may be plastic or other suitable material, with a conventional bearing that surrounds the anchor and allows the wheel to rotate.

While specific embodiments have been described by way of example, it should be understood that the invention is not limited to the disclosed embodiments. To the contrary, this disclosure is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. An articulating bracket pair for hanging a corresponding pair of doors on a horizontal rail affixed to a wall structure, the pair of doors foldably coupled together along a common inside edge, comprising:

a first articulating bracket with a first two-part structure having a top piece and a bottom piece rotatably coupled together, the bottom piece of the first two-part structure adapted to be affixed to a first door of the pair of doors at a top outside corner of the first door, the top piece of the first two-part structure extends upward from the bottom piece, and a wheel or slider mechanism is affixed to and extends from the top piece and is adapted to be removably coupled to the horizontal rail and for rolling or sliding along the horizontal rail; and a second articulating bracket with a second two-part structure having a top piece and a bottom piece rotatably coupled together, the bottom piece of the second two-part structure adapted to be affixed to a second door of the pair of doors at a top outside corner of the second door, the top piece of the second two-part structure extends upward from the bottom piece, and a wheel or slider mechanism is affixed to and extends from the top piece and is adapted to hang on the horizontal rail and be affixed to the wall structure adjacent the horizontal rail.

2. The articulating bracket pair as in claim 1, wherein for each of the first and second two-part structures, the top piece has a vertical portion and a horizontal portion oriented orthogonally to the vertical portion, the vertical portion is disposed above the horizontal portion, the top piece is coupled for rotation to the bottom piece at the horizontal portion.

3. The articulating bracket pair as in claim 1, wherein for each of the first and second two-part structures, the bottom piece has a vertical portion and a first horizontal portion oriented orthogonally to the vertical portion, the vertical portion is disposed below the first horizontal portion, the bottom piece is coupled for rotation to the top piece at the first horizontal portion.

4. The articulating bracket pair as in claim 1, wherein for each of the first and second two-part structures, the bottom piece has a vertical portion, a first horizontal portion oriented orthogonally to the vertical portion and disposed above the vertical portion, a second horizontal portion oriented orthogonally to the vertical portion and disposed below the vertical portion, the bottom piece is coupled for rotation to the top piece at the first horizontal portion.

5. The articulating bracket pair as in claim 1, wherein for the first two-part structure, the wheel or slider mechanism is a roller wheel constructed to roll along the rail.

6. The articulating bracket pair as in claim 5, wherein for each of the first and second two-part structures, the roller wheel has a grooved portion between a first raised lip and a second raised lip, the first raised lip positioned nearer the top piece than the second raised lip and the second raised lip positioned further away from the top piece than the first raised lip, the second raised lip has a smaller diameter than the first raised lip.

7. The articulating bracket pair as in claim 6, wherein the second raised lip has beveled edges.

8. A hanging door system, comprising:

a horizontal rail mounted to a wall structure;

a pair of doors oriented side-by-side as a left-hand door and a right-hand door, the pair of doors connected together at respective proximal edges by one or more hinges;

a first articulating bracket with a first two-part structure having a top piece and a bottom piece rotatably coupled together, the bottom piece of the first two-part structure affixed to a top left portion of the left-hand door, the top piece of the first two-part structure extending upward from the bottom piece, and a first mechanism affixed to and extending from the top piece of the first two-part structure and be affixed to the wall structure adjacent the rail;

a second articulating bracket with a second two-part structure having a top piece and a bottom piece rotatably coupled together, the bottom piece of the second two-part structure affixed to a top right portion of the right-hand door, the top piece extending upward from the bottom piece, and a second mechanism affixed to and extending from the second top piece and adapted to roll or slide along the horizontal rail; and a pivot affixed below a bottom left-hand portion of the left-hand door;

wherein the left-hand door rotates outward in a clockwise direction supported by the pivot and the first articulating bracket when leftward pressure is applied to the right-hand door, with the first bottom piece of the first articulating bracket following the rotation of the left-hand door, and the right-hand door rotates outward in a counterclockwise direction, with the second bottom piece of the second articulating bracket following the rotation of the right-hand door.

9. The hanging door system as in claim 8, wherein the second mechanism is a roller wheel constructed to roll along the rail, the roller wheel has a grooved portion between a first raised lip and a second raised lip, the first raised lip positioned nearer the second top piece of the second articulating bracket than the second raised lip and the second raised lip positioned further away from the top piece of the second articulating bracket than the first raised lip, the second raised lip has a smaller diameter than the first raised lip to facilitate removing the wheel from the rail.

10. The hanging door system as in claim 9, wherein the second raised lip has beveled edges.

* * * * *